US008179217B2

(12) United States Patent
Kawaguchi et al.

(10) Patent No.: US 8,179,217 B2
(45) Date of Patent: May 15, 2012

(54) ELECTROMAGNET DEVICE

(75) Inventors: Kensuke Kawaguchi, Yamaga (JP); Kazuchika Hiroki, Kumamoto (JP)

(73) Assignee: OMRON Corporation, Kyoto (JP)

( * ) Notice: Subject to any disclaimer, the term of this patent is extended or adjusted under 35 U.S.C. 154(b) by 165 days.

(21) Appl. No.: 12/489,936

(22) Filed: Jun. 23, 2009

(65) Prior Publication Data

US 2009/0322453 A1 Dec. 31, 2009

(30) Foreign Application Priority Data

Jun. 30, 2008 (JP) ..... 2008-170514

(51) Int. Cl.
*H01H 51/22* (2006.01)

(52) U.S. Cl. ..... 335/80; 335/78; 335/79; 335/81; 335/84; 335/85; 335/86; 335/124; 335/126; 335/131; 335/132; 335/179; 335/185; 335/195; 335/203; 335/220

(58) Field of Classification Search ..... 335/78–86, 335/124, 126, 128–132, 151, 154, 179, 185, 335/195–201, 202, 203, 220, 248, 281; 200/16, 200/243, 298–305; 218/13, 68–78, 118–126, 218/155–157
See application file for complete search history.

(56) References Cited

U.S. PATENT DOCUMENTS

| | | | | |
|---|---|---|---|---|
| 4,203,084 | A * | 5/1980 | Yamaguchi et al. | 335/202 |
| 4,737,750 | A * | 4/1988 | Prouty | 335/177 |
| 4,782,315 | A * | 11/1988 | Bataille et al. | 335/234 |
| 5,394,128 | A * | 2/1995 | Perreira et al. | 335/126 |
| 5,546,061 | A * | 8/1996 | Okabayashi et al. | 335/78 |
| 5,892,194 | A * | 4/1999 | Uotome et al. | 218/68 |
| 6,911,884 | B2 * | 6/2005 | Uotome et al. | 335/132 |
| 7,852,178 | B2 * | 12/2010 | Bush et al. | 335/126 |
| 7,859,373 | B2 * | 12/2010 | Yamamoto et al. | 335/126 |
| 7,868,720 | B2 * | 1/2011 | Bush et al. | 335/151 |
| 2002/0158727 | A1 * | 10/2002 | Namen | 335/78 |
| 2006/0050466 | A1 * | 3/2006 | Enomoto et al. | 361/160 |
| 2009/0096559 | A1 * | 4/2009 | Yano et al. | 335/187 |

FOREIGN PATENT DOCUMENTS

| | | | |
|---|---|---|---|
| DE | 19744396 | A1 | 4/1999 |
| EP | 179911 | A1 * | 5/1986 |
| EP | 0790627 | A1 | 8/1997 |
| JP | 57198611 | A | 12/1982 |
| JP | 2003-100189 | A | 4/2003 |
| JP | 2007-258150 | A | 10/2007 |

OTHER PUBLICATIONS

Extended European Search Report received in corresponding European application No. 09163390.9 dated Jul. 12, 2011, 6 pages.
Patent Abstracts of Japan, Publication No. 57-198611, Publication date Dec. 6, 1982, 1 page.
Patent Abstracts of Japan, Publication No. 2003-100189, Publication date Apr. 4, 2003, 1 page.

* cited by examiner

*Primary Examiner* — Lincoln Donovan
*Assistant Examiner* — Mohamad Musleh
(74) *Attorney, Agent, or Firm* — Osha Liang LLP

(57) ABSTRACT

A polar electromagnet device has a drive shaft comprising an axis center supported so as to reciprocate in an axis center direction at a center hole of a spool wound with a coil, and a movable iron core attached to a lower end of the drive shaft on the axis center. The drive shaft is reciprocated with the movable iron core which reciprocates based on excitation and demagnetization of the coil. A permanent magnet is integrally arranged at the movable iron core on the same axis center.

2 Claims, 14 Drawing Sheets

ELECTROMAGNET DEVICE

BACKGROUND OF THE INVENTION

1. Technical Field

The present invention relates to electromagnet devices, and in particular, to a polar electromagnet device including a permanent magnet.

2. Related Art

Conventionally, as a polar electromagnet device, a release electromagnet device has been known including a movable armature held in a freely projecting manner in a predetermined direction, a fixed armature arranged facing the movable armature, a tripping spring for biasing the movable armature in the projecting direction, a permanent magnet for holding the tripping spring in an accumulated state, a yoke configuring a magnetic path of the magnetic flux from the permanent magnet through the movable armature and the fixed armature, and an electromagnet for generating a demagnetizing field with respect to the magnetic field by the permanent magnet based on the detection result of an abnormal current, where the magnetic flux density that passes the contacting surface when the movable armature and the fixed armature contact is greater than or equal to one tesla.

SUMMARY

However, as shown in FIG. 1 of Japanese Unexamined Patent Publication No. 2007-258150, the polar electromagnet device has a permanent magnet 5 arranged on the lower end side of a coil bobbin 1. Thus, a movable armature 6 needs to be driven with the magnetic force of a coil 2 against the magnetic force of the permanent magnet 5 in time of operation, and power consumption is large.

In the release electromagnet device, a space for winding the coil 2 is small, and the device enlarges when attempting to obtain high magnetic force with the coil 2.

In view of the above problems, the present invention aims to provide a small polar electromagnet device of small power consumption.

In accordance with one aspect of the present invention, to achieve the above object, there is provided a polar electromagnet device in which a drive shaft is supported so as to reciprocate in an axis center direction at a center hole of a spool wound with a coil, a movable iron core is attached to a lower end of the drive shaft on the same axis center, and the drive shaft is reciprocated with the movable iron core which reciprocates based on excitation and demagnetization of the coil; wherein a permanent magnet is integrally arranged at the movable iron core on the same axis center.

According to the present invention, the permanent magnet integrally arranged on the movable iron core acts repulsively to the magnetic force generated by the excitation of the coil in time of operation, and the movable iron core integrally arranged with the permanent magnet operates, whereby the operation voltage becomes lower than in the related art, and a polar electromagnet device with small power consumption is obtained.

Since the permanent magnet is integrally arranged on the same axis center on the movable iron core, the winding space of the coil becomes larger than in the related art. Thus, more coils can be wound even in the housing having the same outer shape dimension as the related art, and consequently, a smaller polar electromagnet device is obtained.

According to an embodiment of the present invention, an annular auxiliary yoke may be arranged at a position for exerting repulsive force based on a magnetic force generated by the excitation of the coil to the movable iron core in time of operation of an inner circumferential surface of the center hole of the spool.

According to the present embodiment, the movable iron core is driven by the large repulsive force with respect to the permanent magnet in time of operation, and thus a polar electromagnet device with smaller power consumption is obtained.

According to another embodiment of the present invention, an annular auxiliary yoke may be arranged at a position for enhancing a returning force of the movable iron core based on a magnetic force generated by the permanent magnet arranged at the movable iron core in time of returning of the inner circumferential surface of the center hole of the spool.

According to the present embodiment, the magnetic force of the permanent magnet is efficiently utilized as the returning force by the annular auxiliary yoke, and thus a polar electromagnet device having quick operation characteristics is obtained. As the returning force is maintained even after returning is completed, mistaken operation is less likely to occur even by the impact force from the outside, and a polar electromagnet device having high reliability can be obtained.

DETAILED DESCRIPTION

Hereinafter, embodiments of the present invention will be described with reference to the accompanying drawings FIGS. 1A to 14.

As shown in FIGS. 1A to 11, a power load electromagnetic relay applied with a first embodiment of the polar electromagnet device according to the present invention, in brief, has a drive mechanism unit 20 and a contact mechanism unit 50, which are integrated one above the other, accommodated in a case 10, and a cover 70 is fitted to cover the case 10.

Figure 4:
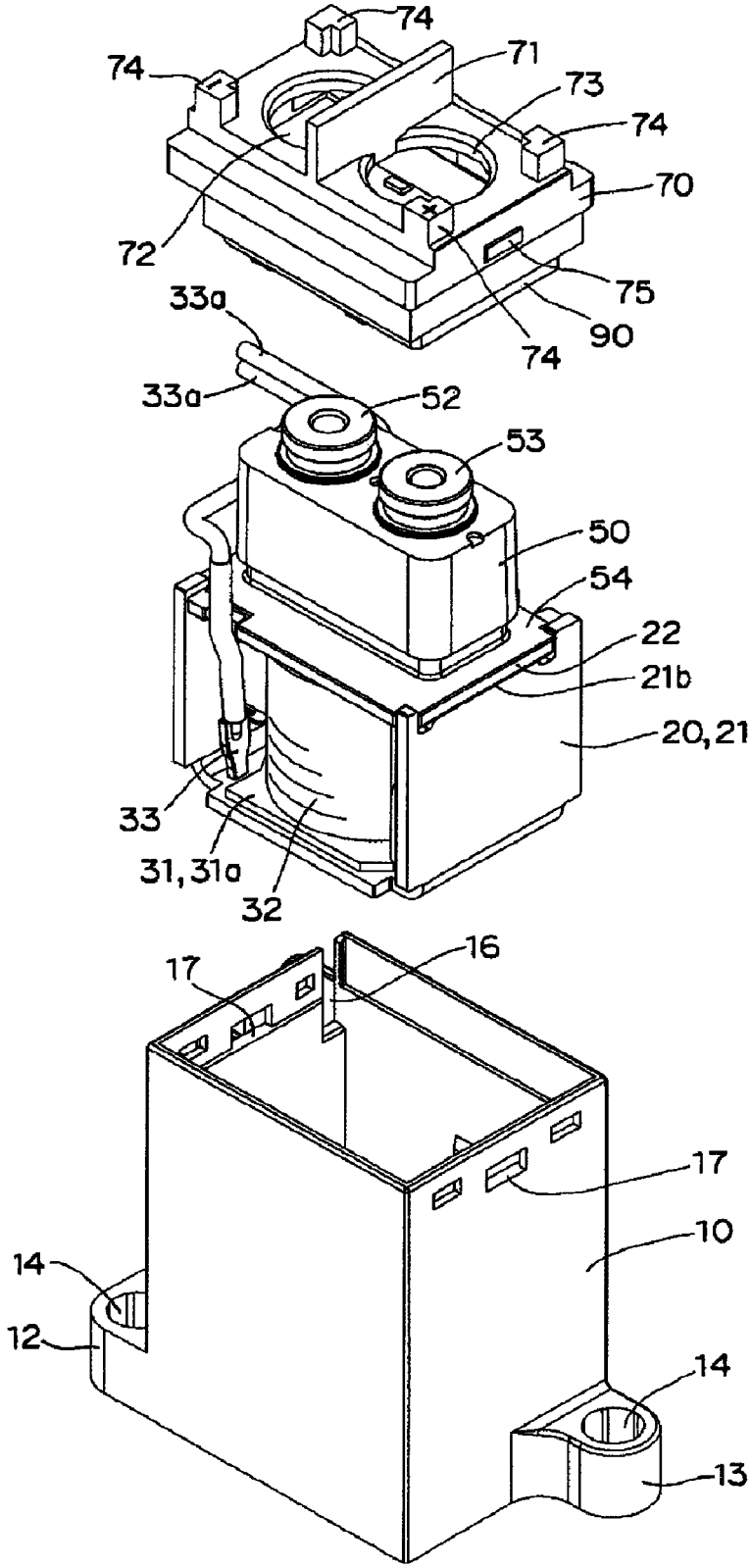
FIG. 4 is an exploded perspective view of the power load electromagnetic relay shown in FIGS. 1A and 1B.

As shown in FIG. 4, the case 10 has a box-shape capable of accommodating the drive mechanism unit 20 and the contact mechanism unit 50, to be hereinafter described, where a fit-in recessed portion 11 (FIGS. 2 and 3) for positioning the drive mechanism unit 20 is formed at the middle of the bottom surface. The case 10 has mounts 12, 13 arranged in a projecting manner towards the side from the lower edge of the outer peripheral corners positioned on a diagonal line. The mounts 12, 13 are respectively formed with attachment holes 14, 14, where a terminal block 15 is integrally molded to the mount 12. Furthermore, the case 10 has a slit 16 for pulling out a lead wire 33*a*, to be hereinafter described, formed at the corner of the opening edge, and an engagement hole 17 for preventing the cover 70, to be hereinafter described, from coming off formed at the opening edge of the opposing side walls.

Figure 5:
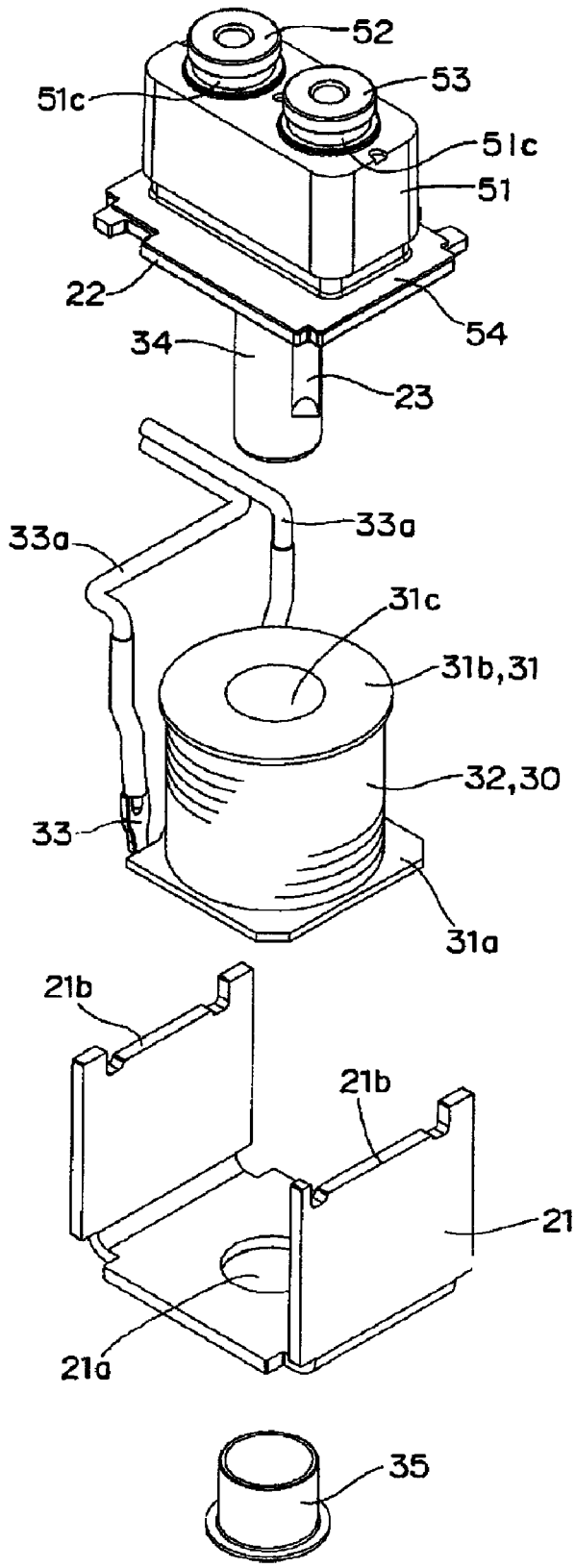
FIG. 5 is an exploded perspective view of the main parts of FIG. 4.
Figure 6:
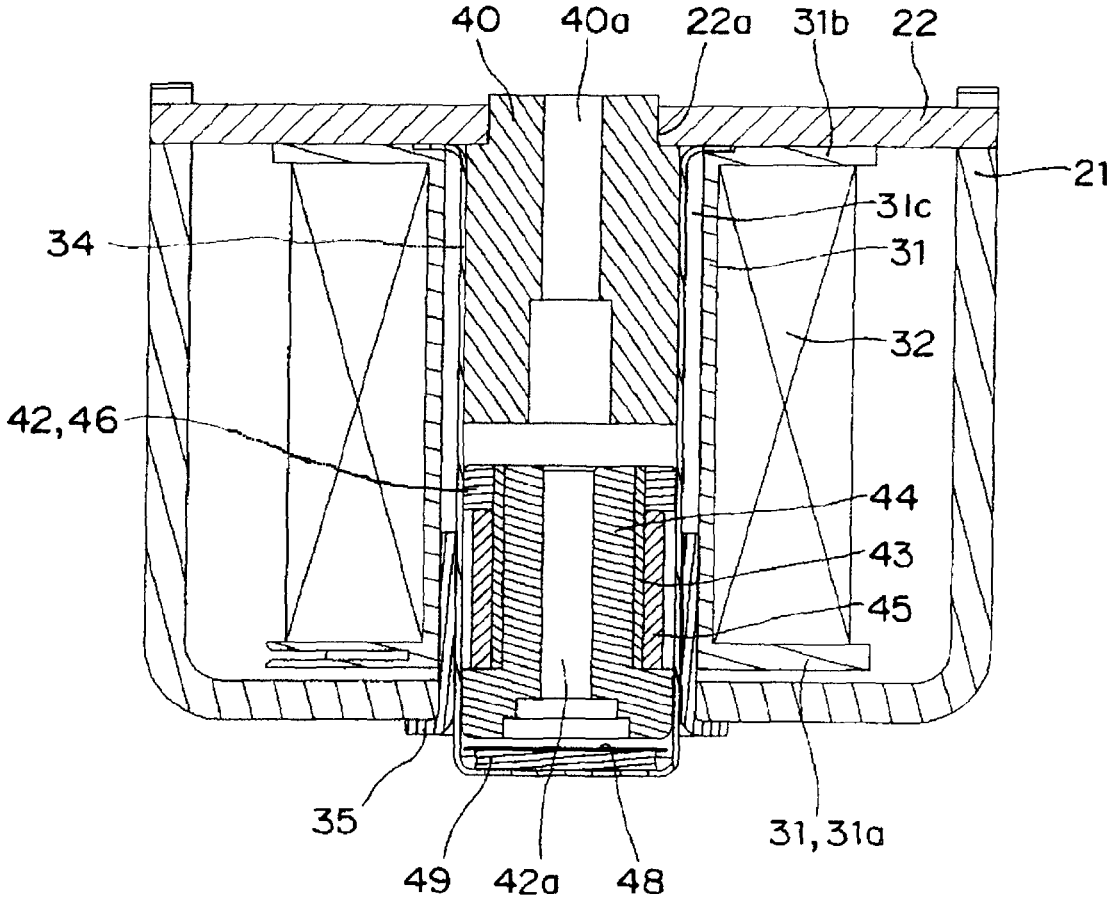
FIG. 6 is a partial enlarged cross-sectional view of FIG. 2.
Figure 7:
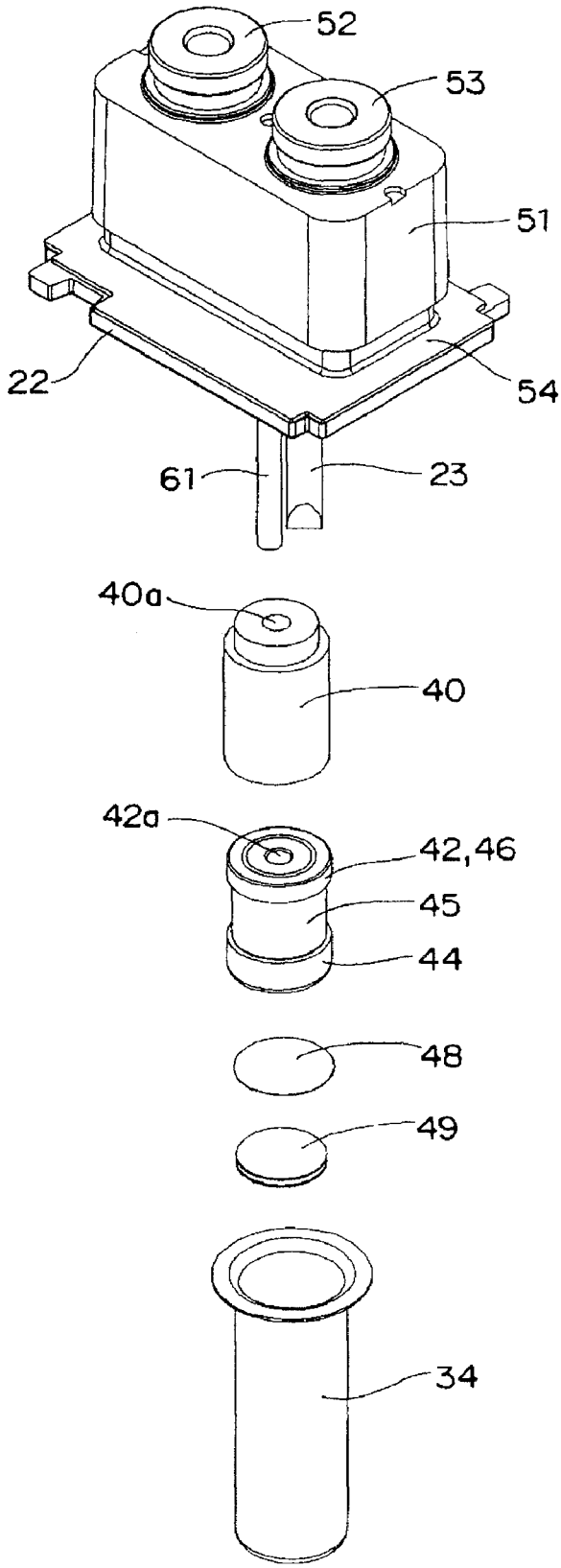
FIG. 7 is an exploded perspective view of the main parts of FIG. 4.

As shown in FIGS. 5 to 7, the drive mechanism unit 20 has an electromagnet block 30, in which a coil 32 is wound around a spool 31, fixed between a first yoke 21 having a substantially U-shaped cross section and a second yoke 22 bridged over both ends of the first yoke 1.

As shown in FIG. 5, the first yoke 21 has an insertion hole 21*a* for inserting a bottomed tubular body 34, to be hereinafter described, formed at the middle of the bottom surface, and cutouts 21*b* for fitting the second yoke 22 formed at both ends.

Figure 10:
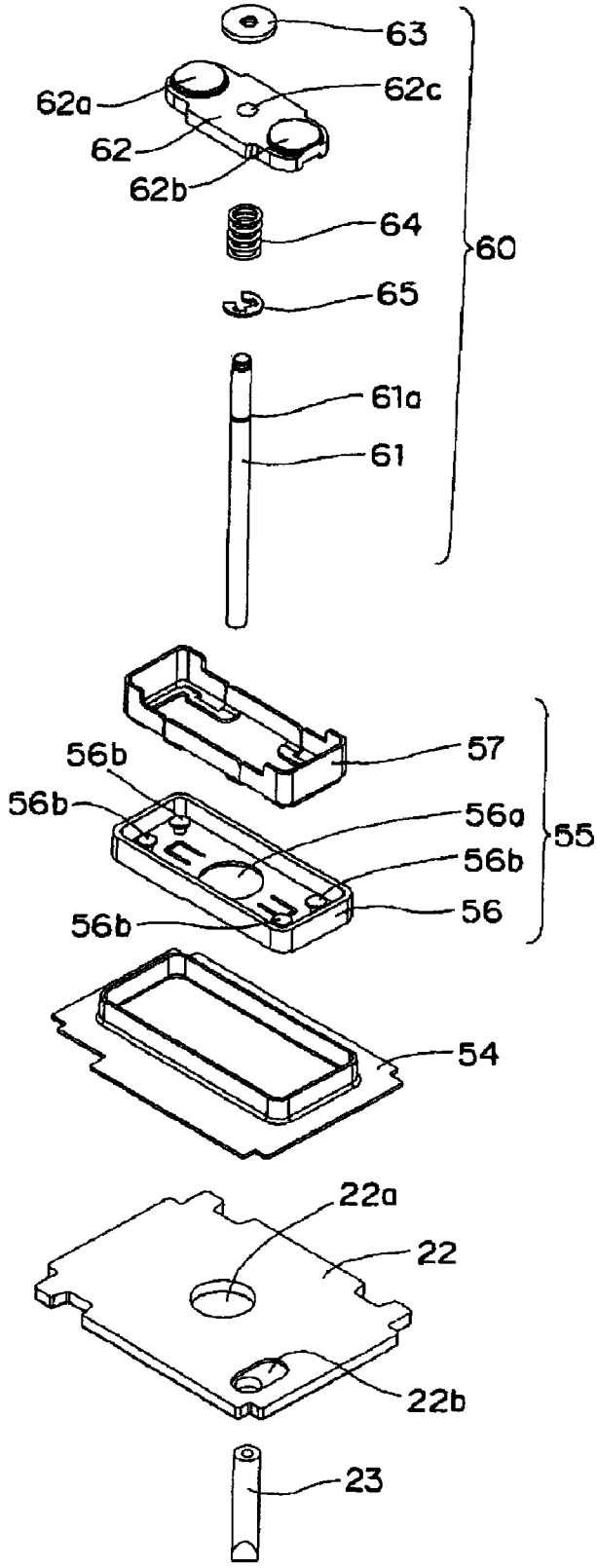
FIG. 10 is an exploded perspective view of the main parts of FIG. 9.

As shown in FIG. 10, the second yoke 22 has both ends formed to a planar shape that can engage to and bridge over the cutouts 21*b* of the first yoke 21, and has a caulking hole 22*a* formed at the middle. The second yoke 22 has a counterbore hole 22*b* formed at the corner on the upper surface, where a gas sealing pipe 23 is air-tightly joined to the counterbore hole 22*b* by brazing.

As shown in FIG. 5, the electromagnet block 30 is formed by wounding the coil 32 around the spool 31 having collar portions 31*a*, 31*b* at both ends, where a pull-out line of the coil 32 is engaged and soldered to a pair of relay terminals 33 (relay terminal on far side is not shown) arranged on the collar portion 31*a*. Lead wires 33*a* are connected to the relay terminals 33, 33. As shown in FIGS. 5 and 6, the bottomed tubular body 34 is inserted to a center hole 31*c* passing through the collar portions 31*a*, 31*b* of the spool 31. The upper opening of the bottomed tubular body 34 is air-tightly joined to the lower surface of the second yoke 22 by laser welding. The bottomed tubular body 34 has an annular auxiliary yoke 35 fitted to the lower end projecting out from the insertion hole 21*a* of the first yoke 21 (FIG. 6).

According to the present embodiment, the annular auxiliary yoke 35 is sandwiched by the bottomed tubular body 34 and the first yoke 21. Thus, the opposing area of an outer circumferential surface of a movable iron core 42, to be hereinafter described, and the first yoke 21 and the annular auxiliary yoke 35 increases and the magnetic resistance reduces, and thus the magnetic efficiency improves and the power consumption reduces.

Figure 1A:
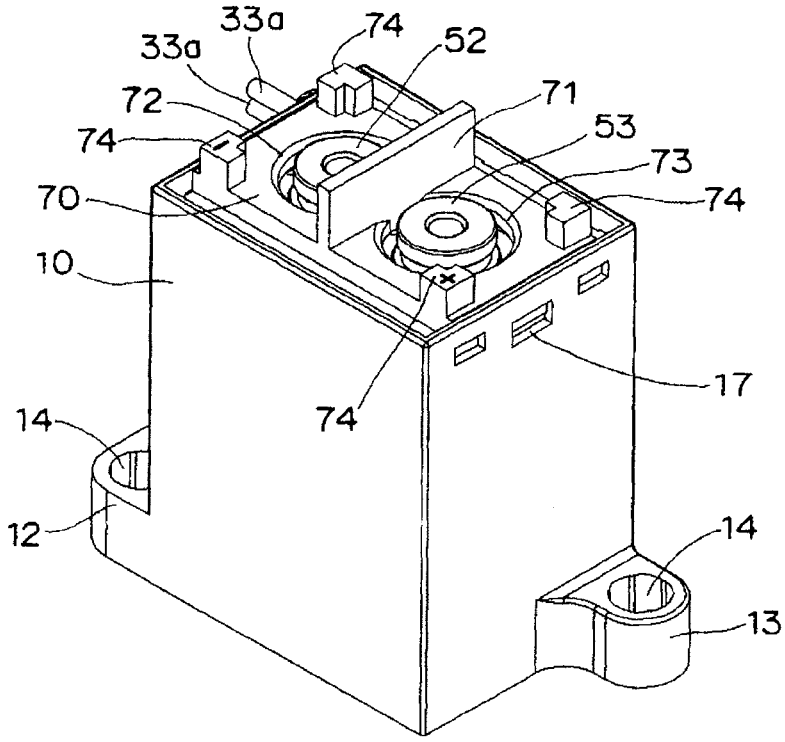
FIGS. 1A and 1B are perspective views each showing a first embodiment of a power load electromagnetic relay applied with a polar electromagnet device according to the present invention.
Figure 1B:
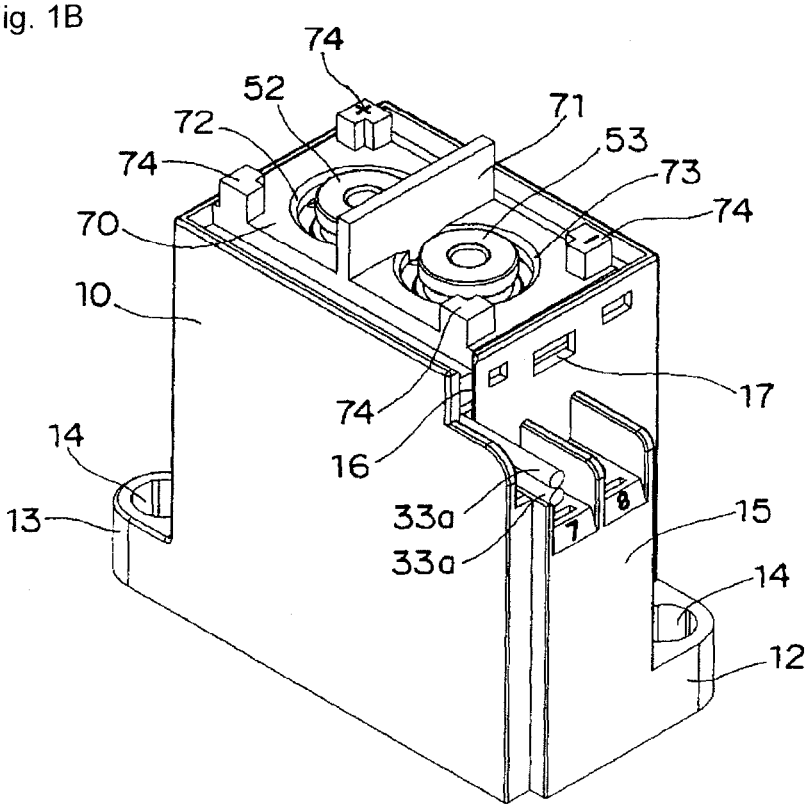
Figure 2:
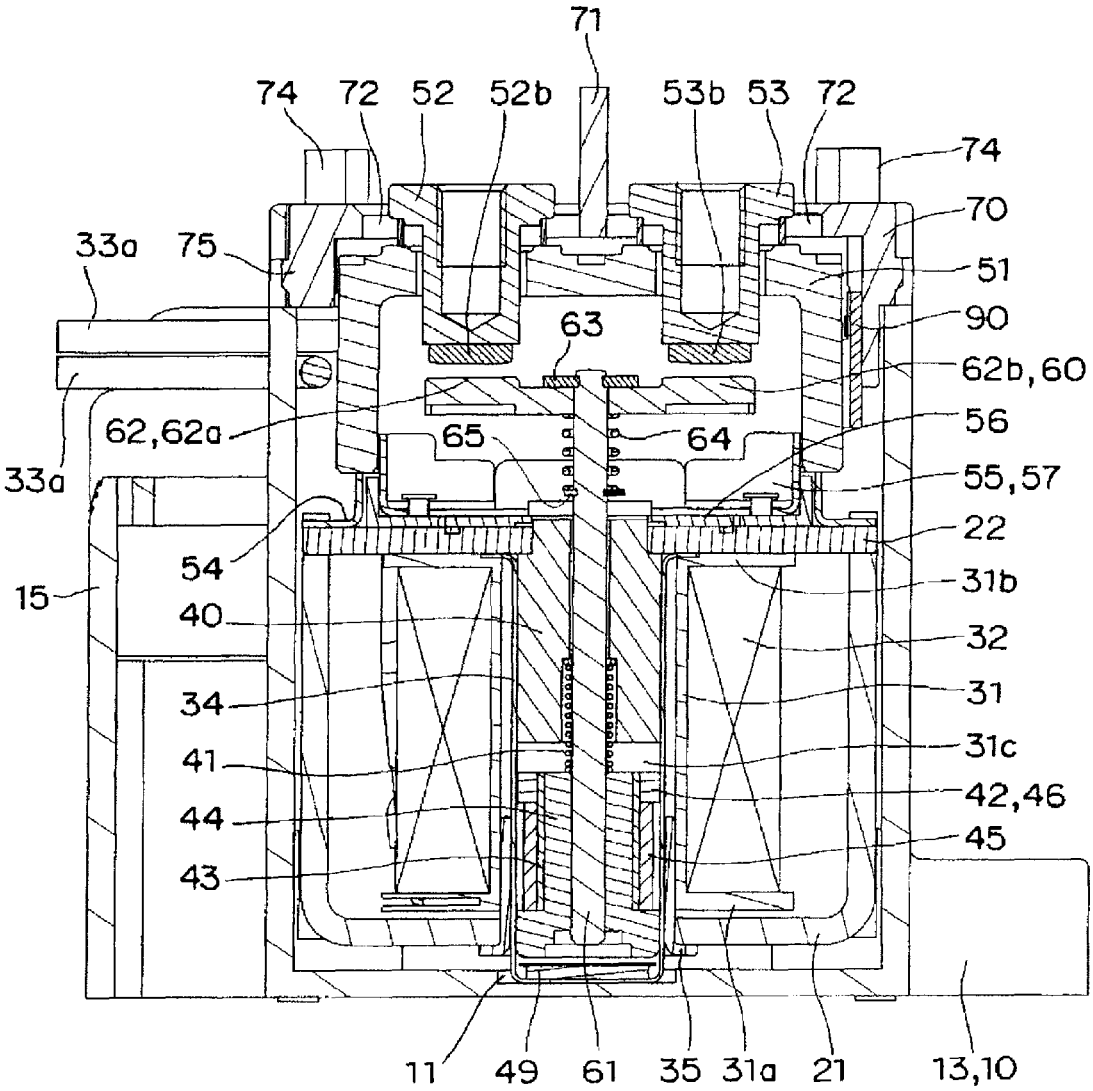
FIG. 2 is a front cross-sectional view of the power load electromagnetic relay shown in FIGS. 1A and 1B.
Figure 3:
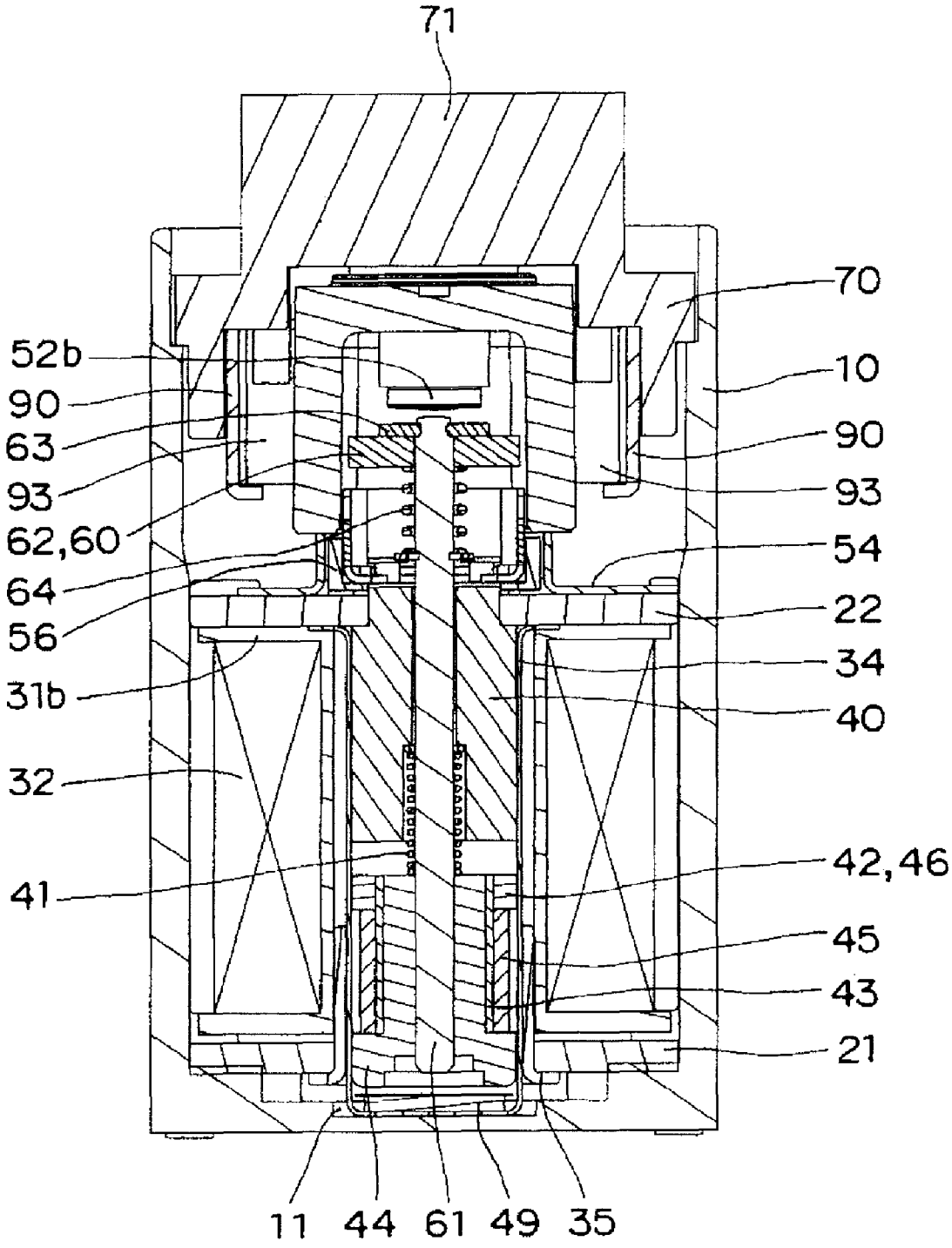
FIG. 3 is a side cross-sectional view of the power load electromagnetic relay shown in FIGS. 1A and 1B.

A shown in FIG. 2, a fixed iron core 40, a returning coil spring 41, and the movable iron core 42 are accommodated in the bottomed tubular body 34. As shown in FIG. 6, the fixed iron core 40 has the upper end caulked and fixed to the caulking hole 22*a* of the second yoke 22. Thus, the movable iron core 42 is biased to the lower side with the spring force of the returning coil spring 41. As shown in FIG. 7, the bottomed tubular body 34 has an adhesion prevention metal sheet 48 and a shock eliminating circular plate 49 made of rubber arranged between the bottom surface and the movable iron core 42.

Figure 8:
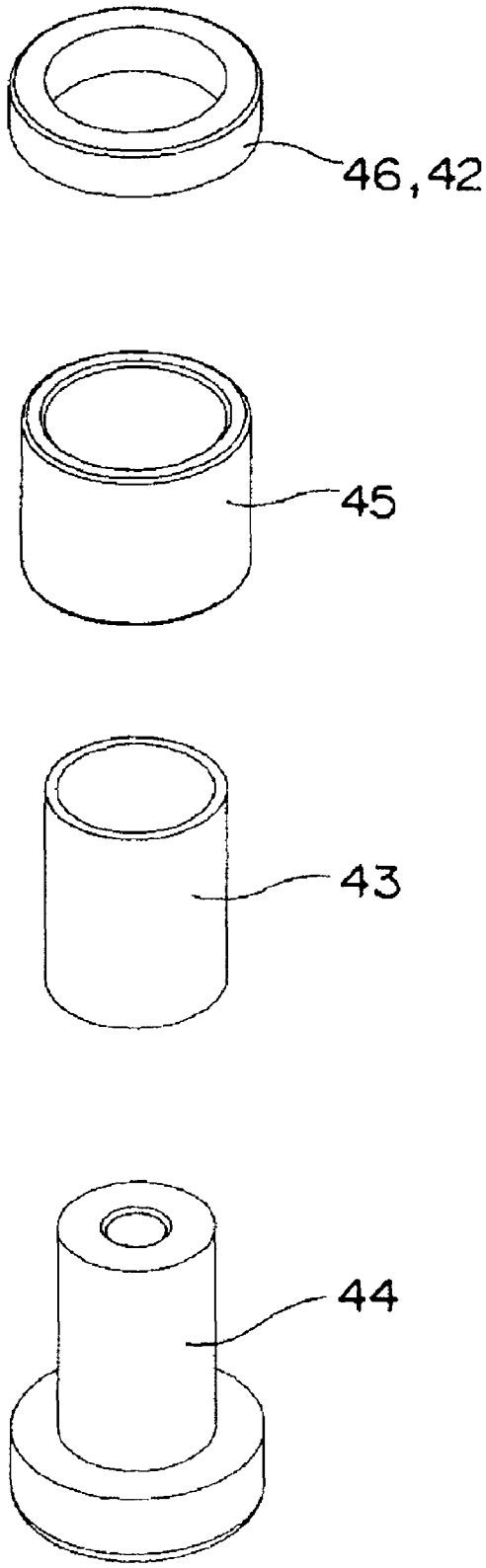
FIG. 8 is an exploded perspective view of the main parts of FIG. 7.

As shown in FIGS. 6 and 8, the movable iron core 42 has a first movable iron piece 44 inserted into a connection pipe 43 made of non-magnetic material, and a ring-shaped permanent magnet 45 and a second movable iron piece 46 fitted to and integrated with the outer peripheral surface of the connection pipe 43. Thus, a desired magnetic circuit can be formed by shielding the magnetic power of the ring-shaped permanent magnet 45 with the connection pipe 43. In time of returning, the second movable iron piece 46 is positioned above the opening edge of the annular auxiliary yoke 35. FIGS. 6 and 7 do not show the returning coil spring 41 for the sake of convenience of explanation.

Figure 9:
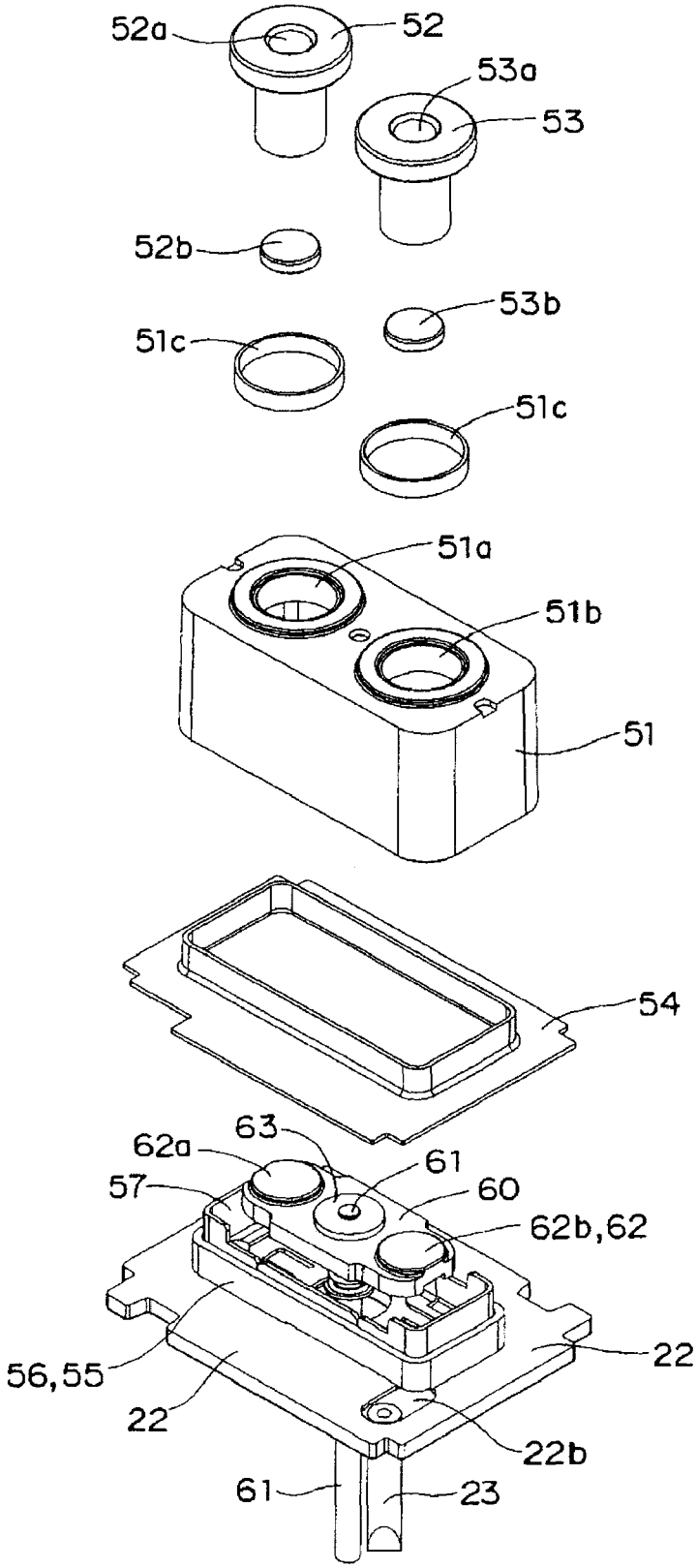
FIG. 9 is an exploded perspective view of the main parts of FIG. 7.

As shown in FIG. 9, the contact mechanism unit 50 has a shield member 55 and a movable contact block 60 arranged in a sealed space formed by connecting and integrating a ceramic sealing container 51 to the upper surface of the second yoke 22.

The sealing container 51 has fixed contact terminals 52, 53 having a substantially T-shaped cross section brazed to terminal holes 51*a*, 51*b* formed at the roof surface by way of washers 51*c*, 51*c*, and a connection annular skirt portion 54 brazed to the lower opening edge. The fixed contact terminals 52, 53 have screw holes 52*a*, 53*a* formed at the upper surface, and fixed contacts 52*b*, 53*b* arranged at the lower end face. The annular skirt portion 54 is positioned on the upper surface of the second yoke 22, and then welded and integrated with laser to form the sealed space.

As shown in FIG. 10, the shield member 55 is integrated by fitting a metal shield ring 57 to a box-shaped resin molded article 56 having a shallow bottom with a pass-through hole 56*a* at the middle, and caulking a caulking projection 56*b* arranged in a projecting manner at the bottom surface of the box-shaped resin molded article 56. The metal shield ring 57 draws the arc generated in time of contact opening/closing, and prevents the brazed part of the sealing container 51 and the connection annular skirt portion 54 from melting.

As shown in FIG. 10, the movable contact block 60 has an upper end of a drive shaft 61 inserted to a caulking hole 62*c* of the movable contact 62 formed with movable contact points 62*a*, 62*b* at both ends, and caulked and fixed by way of a washer 63. A contact-pressure coil spring 64 is inserted to the drive shaft 61 from the lower side, and an E ring 65 is engaged and assembled to an annular groove 61*a* formed on the outer circumferential surface of the drive shaft 61. Thus, the movable contact 62 is biased upward by way of the pressure-contact coil spring 64.

The pressure-contact coil spring 64 applies contact pressure to the movable contact 62. Thus, the attractive force characteristics can be adjusted and the degree of freedom in design can be extended by appropriately selecting the contact-pressure coil spring 64.

Figure 11:
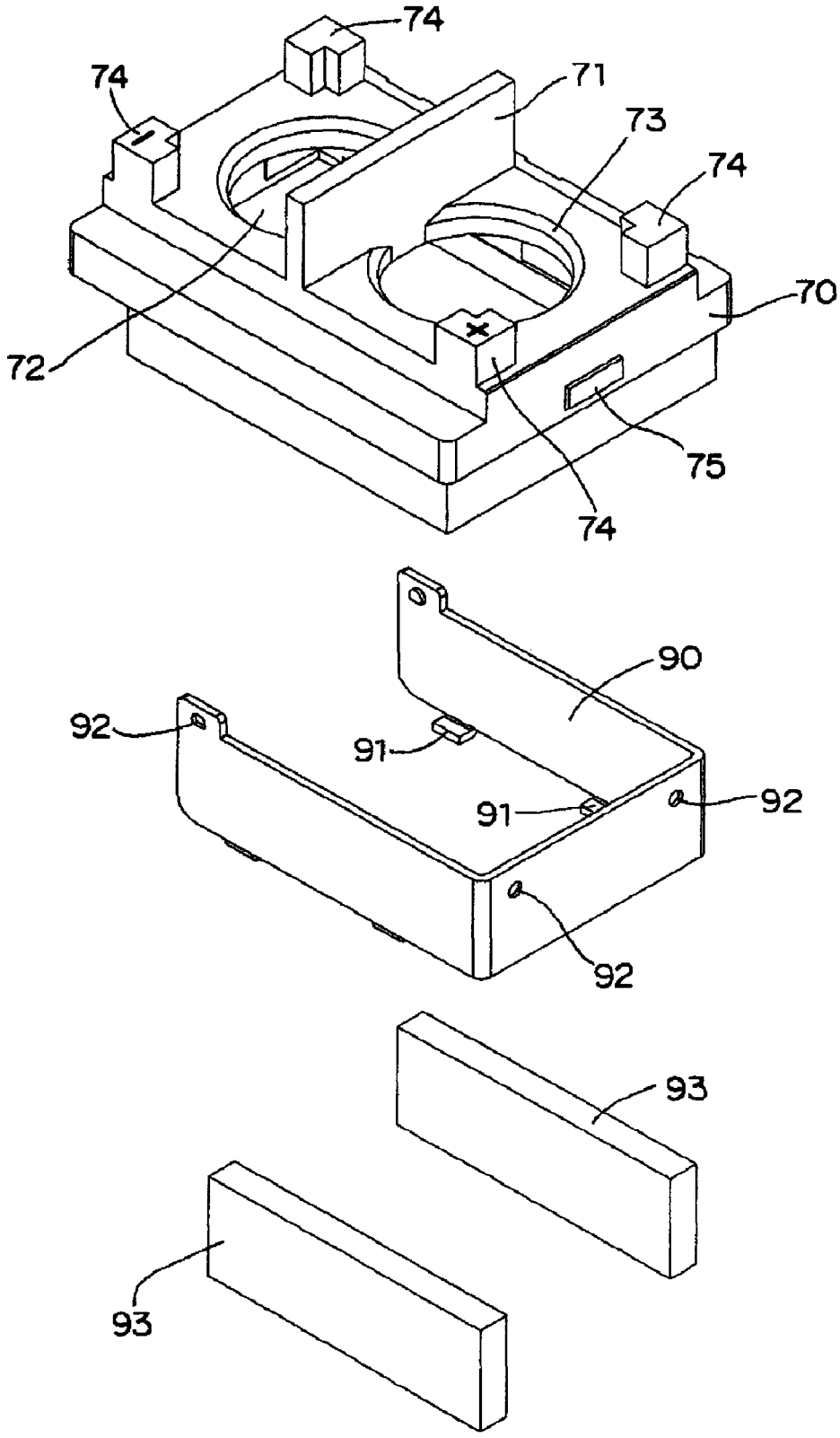
FIG. 11 is an exploded perspective view of the main parts of FIG. 4.

As shown in FIG. 4, the cover 70 has a plan shape that can be fitted to the case 10. As shown in FIG. 11, the cover 70 is fitted at the inner side surface with a holding member 90 made of magnetic material and having a substantially U-shape in plan view.

The cover 70 has terminal holes 72, 73 formed on both sides of an insulation protrusion 71 formed at the middle of the roof surface. The cover 70 also has a rotation-preventing projection 74 for an external terminal (not shown) arranged in a projecting manner at the corner of the roof surface, and an engagement projection 75 arranged in a projecting manner to the side from both side surfaces on the short side.

The holding member 90 has a positioning nail 91 raised from the lower edge on the opposing inner side surface, and a positioning recessed portion 92 formed through extrusion processing. Two permanent magnets 93 are arranged facing each other by way of the positioning projection 91. The permanent magnet 93 pulls the arc generated between the movable contact 62 and the fixed contact terminals 52, 53 with the magnetic force and allows the arc to be easily extinguished, prevents contact adhesion, and protects the brazed portion of the sealed container 51.

A method of assembling the seal contact device according to the present embodiment will now be described.

First, the electromagnet block 30 in which the coil 32 is wound around the spool 31 is placed and positioned at the first yoke 21. The shield member 55 is positioned at the middle of the upper surface of the second yoke 22 caulked and fixed with the fixed iron core 40 in advance, and the drive shaft 61 of the movable contact block 60 is inserted to the pass-through hole 56*a* of the shield member 55 and the shaft hole 40*a* of the fixed iron core 40. The inner peripheral edge of the sealed container 51 brazed with the fixed contact terminals 52, 53 and the annular skirt portion 54 is fitted to the shield ring 57 of the shield member 55. The annular skirt portion 54 is laser welded and integrated to the upper surface of the second yoke 22 while pushing the box-shaped molded article 56 with the lower end face of the opening edge of the sealed container 51.

The drive shaft 61 projecting out from the lower surface of the fixed iron core 40 is then inserted to the returning coil spring 41 and the shaft hole 42*a* of the movable iron core 42. The movable iron core 42 is pushed in against the spring force of the returning coil spring 41 until contacting the fixed iron core 40. Furthermore, the drive shaft 61 is pushed in until obtaining a predetermined contact pressure, a state in which the movable contact 62 contacts the fixed contacts 52*a*, 53*a* of the fixed contact terminals 52, 53 with a predetermined contact pressure is maintained, and the lower end of the drive shaft 61 is welded and integrated with the movable iron core 42. Thereafter, the bottomed tubular body 34 sequentially accommodating the shock eliminating circular plate 49 made of rubber and the adhesion prevention metal sheet 48 is placed over the movable iron core 42, and the opening edge thereof is welded and integrated through laser welding to the lower surface of the second yoke 22. After releasing the air in the sealed space from the gas sealing pipe 23, inactive gas is injected, and the gas sealing pipe 23 is caulked and sealed.

Furthermore, the bottomed tubular body 34 is inserted to the center hole 31*c* of the spool 31, and both ends of the second yoke 22 are fitted to and caulked and fixed to the cutouts 21*b* of the first yoke 22. The annular auxiliary yoke 35 is fitted to and prevented from coming off from the lower end of the bottomed tubular body 34 projecting out from the insertion hole 21*a* of the first yoke 21.

As shown in FIG. 4, the drive mechanism unit 20 and the contact mechanism unit 50 integrated one above the other are then inserted into the base 10. The lower end of the projecting bottomed tubular body 34 is fitted to and positioned in the recessed portion 11 of the base 10 and the lead wire 33*a* is pulled out from the cutout 16 of the base 10. The engagement nail 75 of the cover 70 is then engaged and fixed to the engagement hole 17 of the base 10. The power load electromagnetic relay according to the present embodiment is thereby obtained.

The operation of the contact device according to the present embodiment will now be described.

As shown in FIG. 2, when voltage is not applied to the coil 32, the movable iron core 42 is separated from the fixed iron core 40 by the spring force of the returning coil spring 41 and the magnetic force of the permanent magnet 45 of the movable iron core 42. Thus, movable contacts 62*a*, 62*b* positioned at both ends of the movable contact 62 are separated from the fixed contacts 52*b*, 53*b* of the fixed contact terminals 52, 53.

When voltage is applied to the coil 32, and the movable iron core 42 moves towards the fixed iron core 40 against the spring force of the returning coil spring 41 by the combined force of the attractive force of the fixed iron core 40 with respect to the movable iron core 42 and the repulsive force of the ring-shaped permanent magnet 45 of the movable iron core 42 on the magnetic flux of the coil 32. Thus, the drive shaft 61 integral with the movable iron core 42 moves in the axis center direction, and the movable contacts 62*a*, 62*b* of the movable contact 62 contact the fixed contacts 52*b*, 53*b* of the fixed contact terminals 52, 53.

According to the present embodiment, the magnetic force of the ring-shaped permanent magnet 45 can be effectively used during the operation, and thus the movable iron core 42 can be driven with small power consumption. Furthermore, the magnetic flux generated at the coil 32 can pass through the annular auxiliary yoke 35, the magnetic efficiency improves, and greater repulsive force can be obtained, whereby the electromagnetic relay with smaller power consumption is obtained.

The movable iron core 42 is attracted towards the fixed iron core 40, the movable iron core 42 moves against the spring force of the returning coil spring 41, and the contact pressure increases. The movable contacts 62*a*, 62*b* of the movable contact 62 then contact the fixed contacts 52*b*, 53*b* of the fixed contact terminals 52, 53 at a predetermined pressure against the spring force of the returning coil spring 41, and thereafter, the movable iron core 42 is attracted to the fixed iron core 40, and such a state is maintained.

Finally, when application of voltage on the coil 32 is stopped, the magnetic force of the coil 32 disappears, and the movable iron core 42 separates from the fixed iron core 40 by the spring force of the returning coil spring 41. Then, the movable iron core 42 returns to the original position after the movable contact 62 separates from the fixed contact terminals 52, 53. In returning, the movable iron core 42 impacts the shock eliminating circular plate 49 by way of the adhesion prevention metal sheet 48, whereby the impact force is absorbed and alleviated.

According to the present embodiment, the magnetic flux of the ring-shaped permanent magnet 45 forms a magnetic circuit by way of the annular auxiliary yoke 35 in time of returning. Thus, the returning operation of the movable iron core 42 becomes quick by effectively using the magnetic force of the ring-shaped permanent magnet 45 even in time of returning, and an electromagnetic relay excelling in operation characteristics can be obtained.

Figure 12:
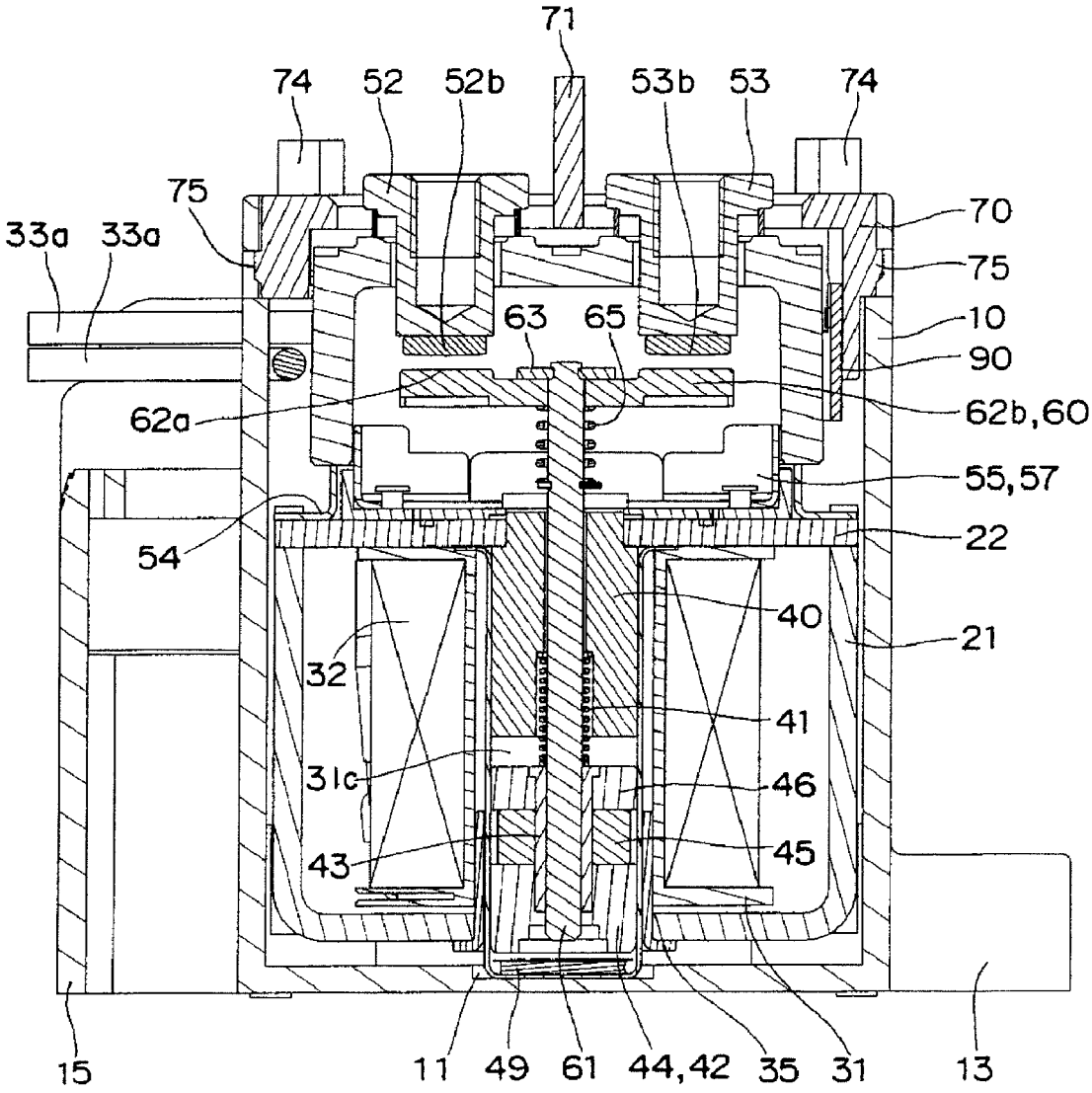
FIG. 12 is a front cross-sectional view showing a second embodiment of a power load electromagnetic relay applied with a polar electromagnet device according to the present invention.

A second embodiment is substantially the same as the first embodiment but differs in the structure of the movable iron core 42, as shown in FIG. 12.

In other words, the movable iron core 42 has a shaft hole of an inner diameter capable of receiving the drive shaft 61, and has the first movable iron piece 44, the ring-shaped permanent magnet 45, and the second movable iron piece 46 fitted to and integrated with the connection pipe 43 made of non-magnetic material.

According to the present embodiment, the ring-shaped permanent magnet 45 is arranged so as to be directly sandwiched by the first movable iron piece 44 and the second movable iron piece 46, and thus an electromagnetic relay in which the assembly precision is high and the operation characteristics are not varied is obtained.

Others are the same as the first embodiment, and thus same reference numbers are denoted for the same portions and the description will not be given.

Figure 13:
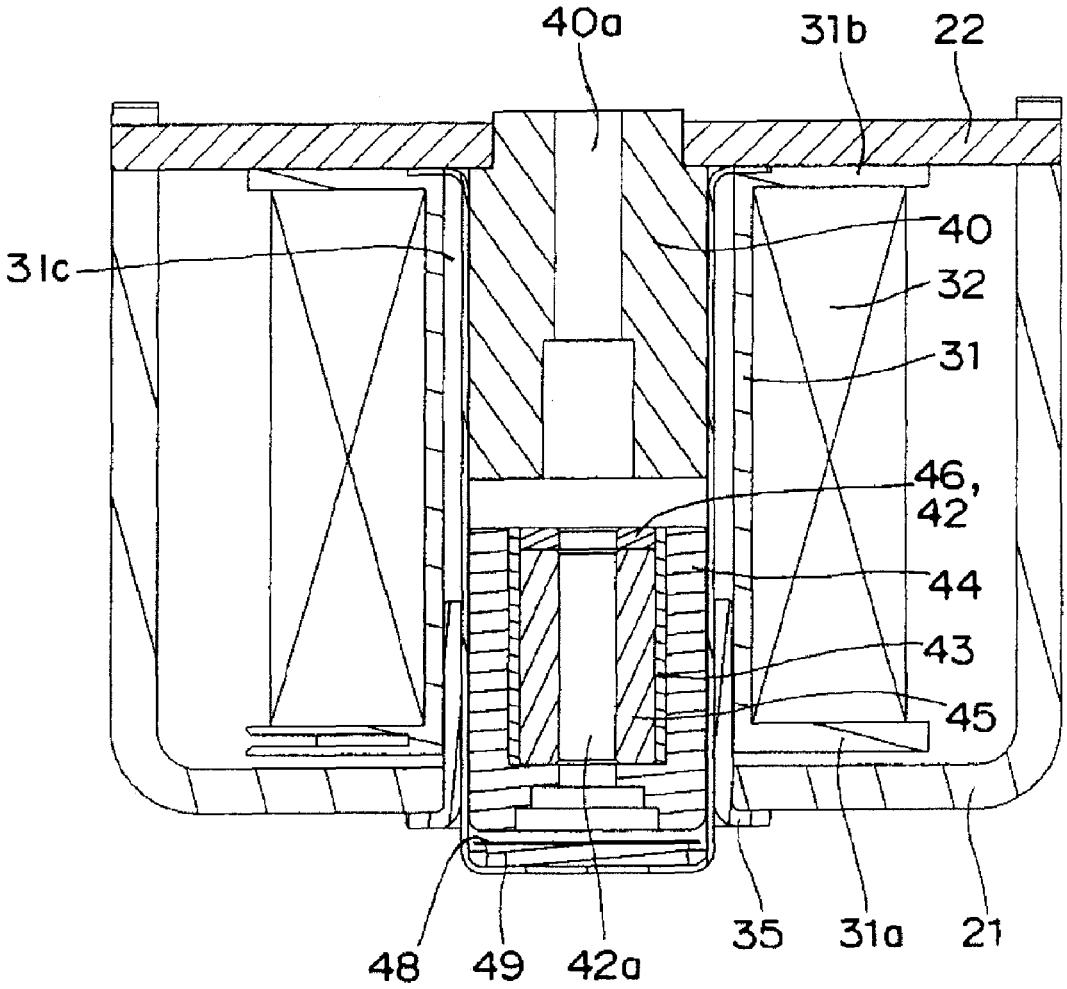
FIG. 13 is a front cross-sectional view showing a third embodiment of a polar electromagnet device according to the present invention.
Figure 14:
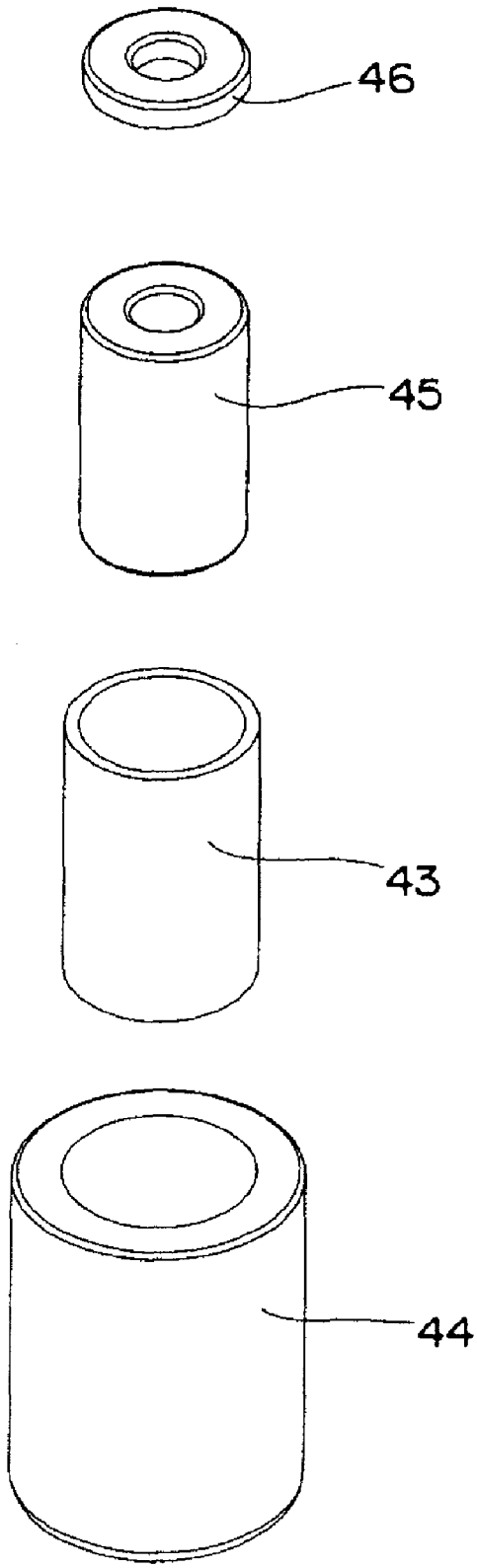
FIG. 14 is an exploded perspective view of the main parts of the polar electromagnet device shown in FIG. 13.

A third embodiment is substantially the same as the first embodiment but differs in the structure of the movable iron core 42, as shown in FIGS. 13 and 14.

In other words, the movable iron core 42 has the first movable iron piece 44 fitted to the outer peripheral surface of the connection pipe 43 made of magnetic material, and has the ring-shaped permanent magnet 45 having a shaft hole of an inner diameter capable of receiving the drive shaft 61 and the second movable iron piece 46 fitted and integrated at the interior.

According to the present embodiment, the outermost side surface of the movable iron core 42 is covered by the first movable iron piece 44, and the first movable iron piece 44 is shielded by the connection pipe 43 made of non-magnetic material. Thus, the magnetic force generated at the coil 32 easily passes through the first movable iron piece 44 and the magnetic circuit can be formed, whereby an electromagnetic relay obtaining large attractive force and having high magnetic efficiency can be obtained.

Others are the same as the first embodiment, and thus same reference numbers are denoted for the same portions and the description will not be given.

It should be recognized that the polar electromagnet device according to the present invention is not limited to the electromagnetic relay described above, and can be applied to other electric devices.

What is claimed is:

1. A polar electromagnet device comprising:

a drive shaft comprising an axis center supported so as to reciprocate in an axis center direction at a center hole of a spool wound with a coil;

a fixed iron core disposed within the center hole of the spool;

a movable iron core attached to a lower end of the drive shaft on the axis center, wherein the movable iron core comprises:

a first movable iron piece;

a second movable iron piece, wherein the first moveable iron piece is disposed radially adjacent to the second movable iron piece with respect to the axis center;

a permanent magnet directly sandwiched by the first movable iron piece and the second movable iron piece, wherein the permanent magnet is disposed radially adjacent to the second moveable iron piece with respect to the axis center; and a coil spring disposed on the drive shaft and configured to bias the movable iron core away from the fixed iron core, wherein the drive shaft is reciprocated with the movable iron core which reciprocates based on excitation and demagnetization of the coil.

2. The polar electromagnet device according to claim 1, further comprising:

a first yoke and an auxiliary yoke, wherein the auxiliary yoke is disposed through an opening in the bottom of the first yoke, and wherein the drive shaft is arranged within the first yoke.

* * * * *